US005672793A

United States Patent [19]

Bares et al.

[11] Patent Number: 5,672,793

[45] Date of Patent: Sep. 30, 1997

[54] STABILIZATION OF HYDROCARBONS BY THE ADDITION OF HYDRAZINE

[75] Inventors: Joseph E. Bares; Byron G. Johnson, both of Bartlesville, Okla.; Frederick J. Cornforth, Sweeny, Tex.

[73] Assignee: Phillips Petroleum Company, Bartlesville, Okla.

[21] Appl. No.: 486,734

[22] Filed: Jun. 7, 1995

Related U.S. Application Data

[62] Division of Ser. No. 261,595, Jun. 17, 1994, Pat. No. 5,470,457.

[51] Int. Cl.[6] ..... C07C 7/20

[52] U.S. Cl. ..... 585/5; 585/4; 208/48 AA; 208/255

[58] Field of Search ..... 208/48 AA, 15, 208/16, 17, 18, 19, 255; 585/2, 4, 5

[56] References Cited

U.S. PATENT DOCUMENTS

| | | | |
|---|---|---|---|
| 3,655,556 | 4/1972 | Allen | 252/32.7 |
| 3,793,187 | 2/1974 | Marx et al. | 208/289 |
| 3,873,277 | 3/1975 | Coon | 44/64 |
| 4,444,649 | 4/1984 | Dvoracek | 208/48 AA |
| 4,524,006 | 6/1985 | Sandel | 252/51.5 |
| 5,160,425 | 11/1992 | Lewis | 208/95 |
| 5,180,485 | 1/1993 | Pennella et al. | 208/254 |
| 5,213,678 | 5/1993 | Rondum et al. | 208/48 AA |

OTHER PUBLICATIONS

Kirk–Othmer Encyclopedia of Chemical Technology, Third Ed., vol. 3, pp. 128–148, "Antioxidants and Antiozonants".

*Primary Examiner*—Glenn A. Caldarola
*Assistant Examiner*—Bekir L. Yildirim
*Attorney, Agent, or Firm*—Ryan N. Cross

[57] ABSTRACT

Hydrocarbon-containing fluid compositions are provided comprising at least one hydrocarbon fluid, at least one heteroaromatic, and at least one hydrazine additive. The resulting composition has reduced temporal formation of colored materials and/or gummy deposits. Additionally, antioxidant additives are combined with the above composition and provide a further reduction in the formation of colored materials and/or gummy deposits.

8 Claims, 7 Drawing Sheets

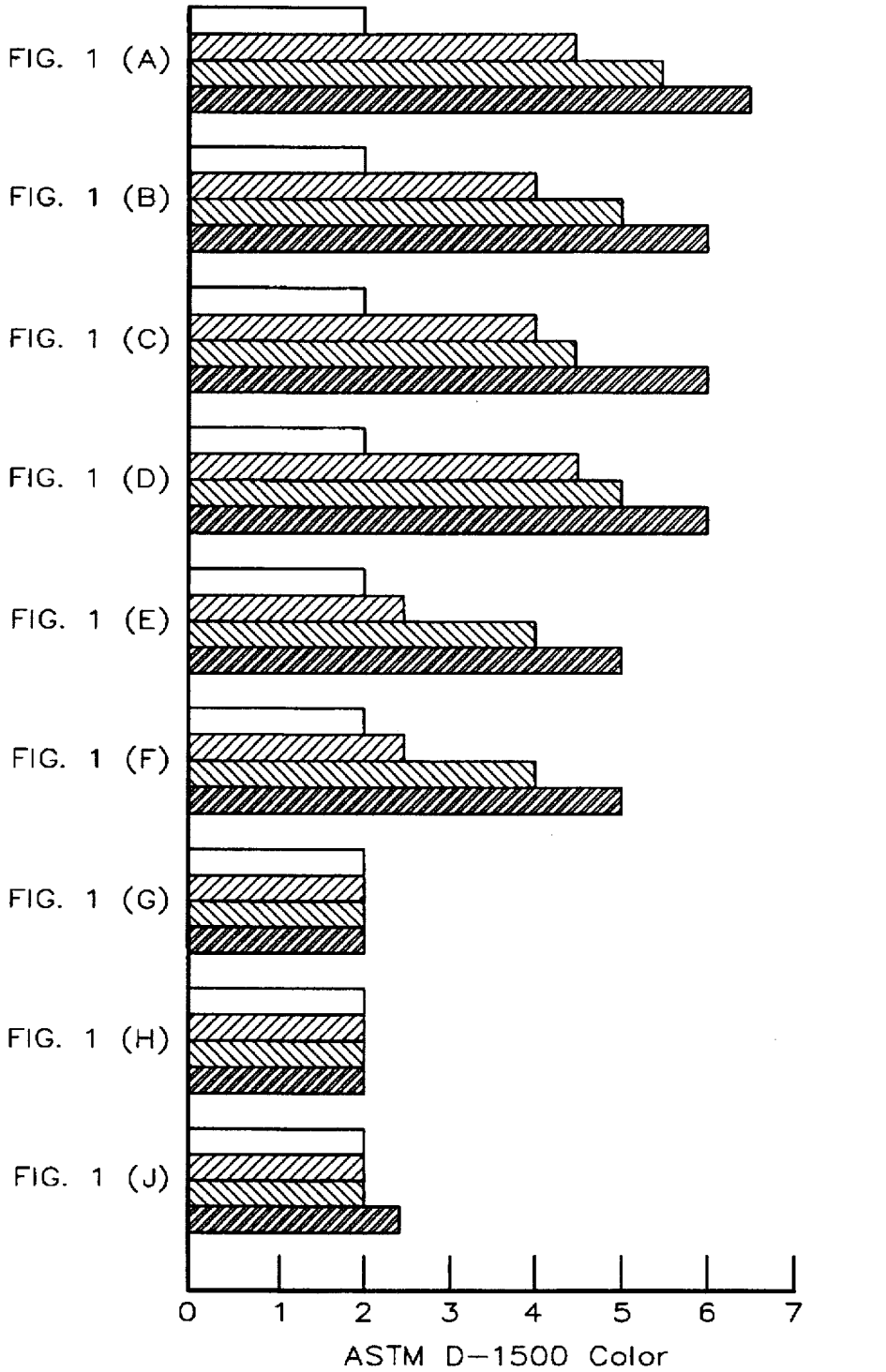
*FIG. 1*
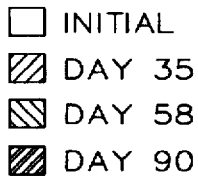

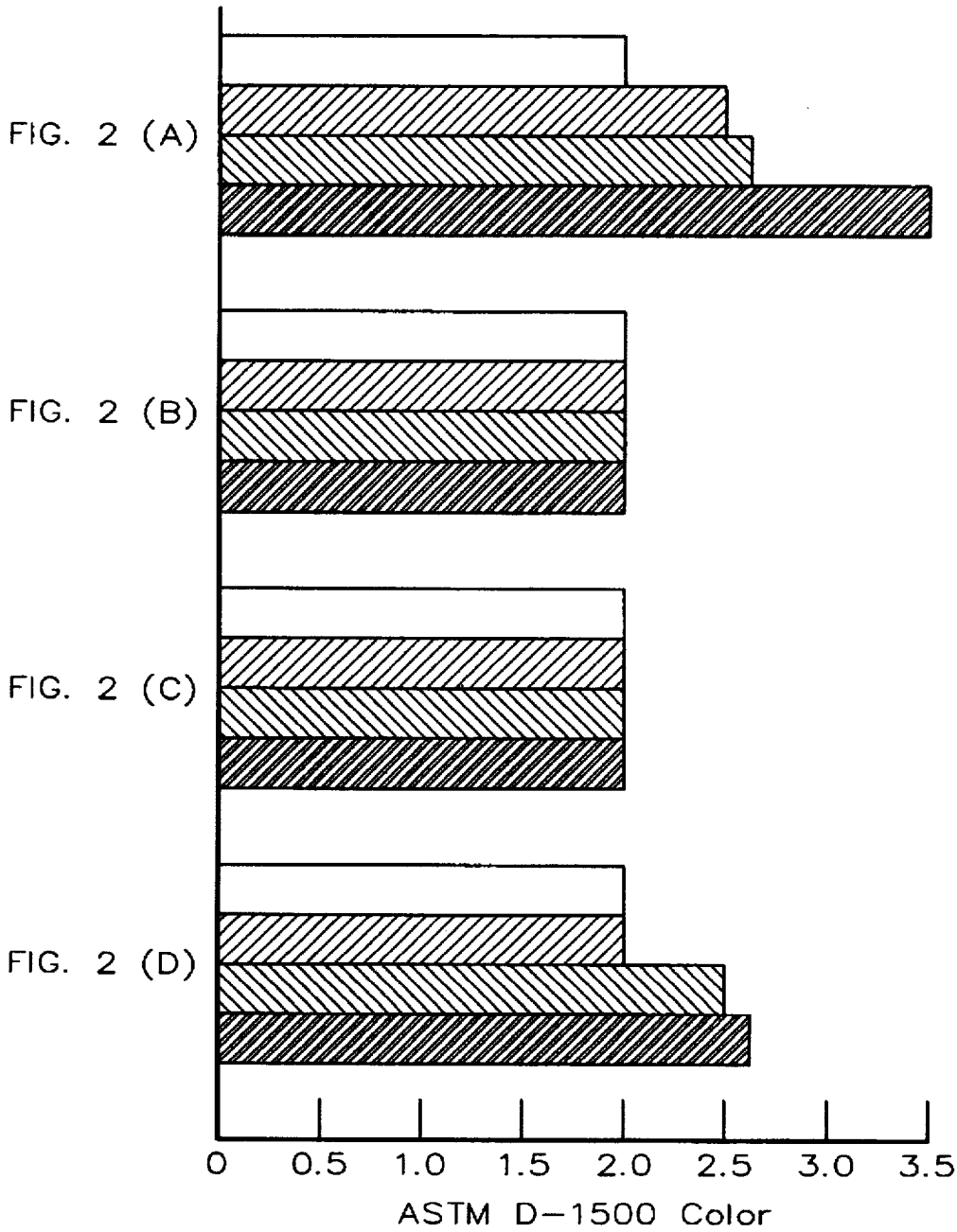
*FIG. 2*
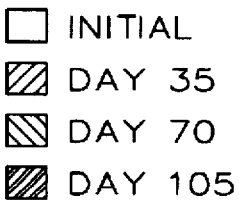

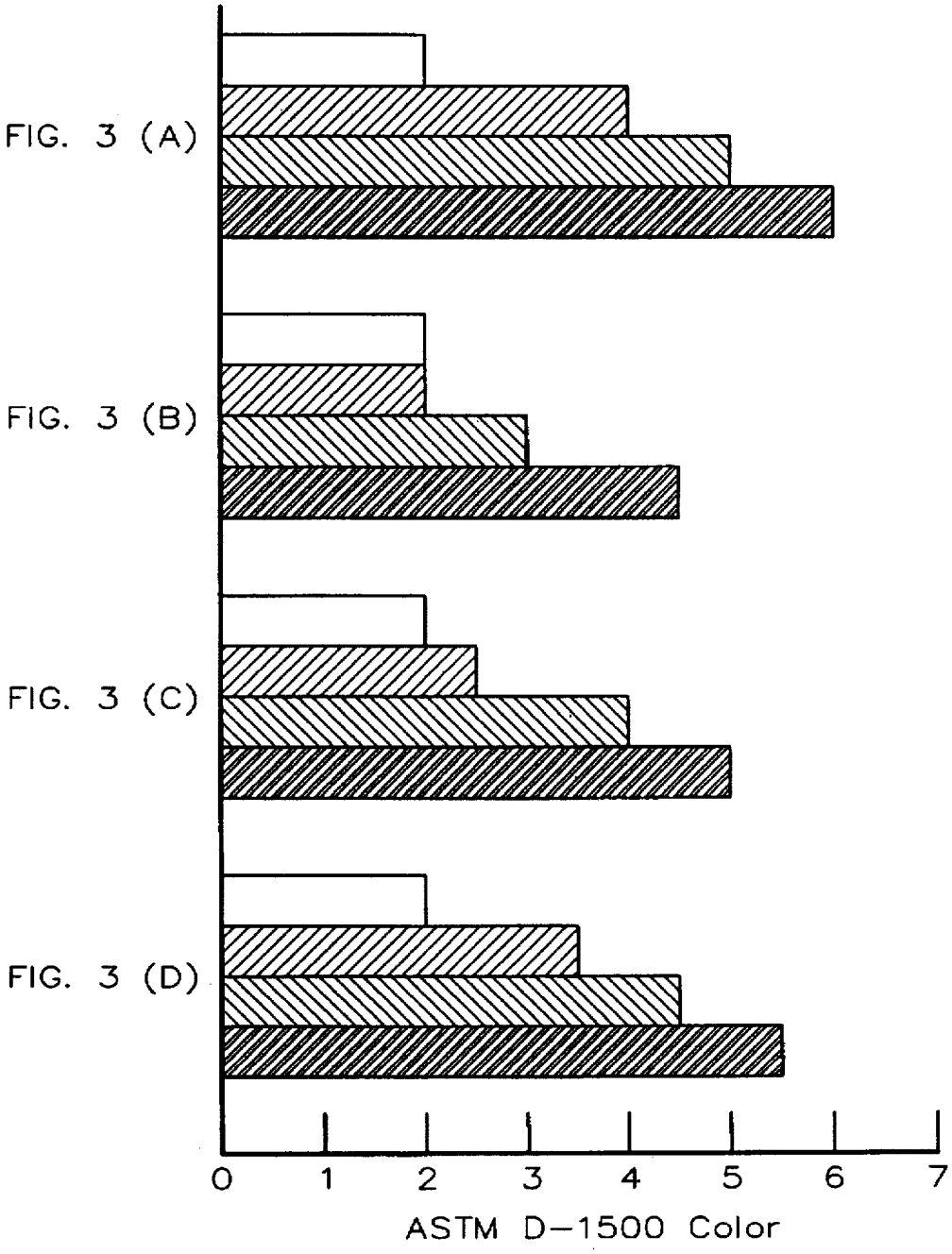
*FIG. 3*
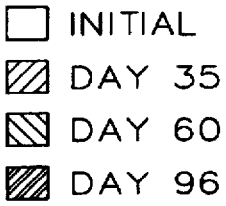

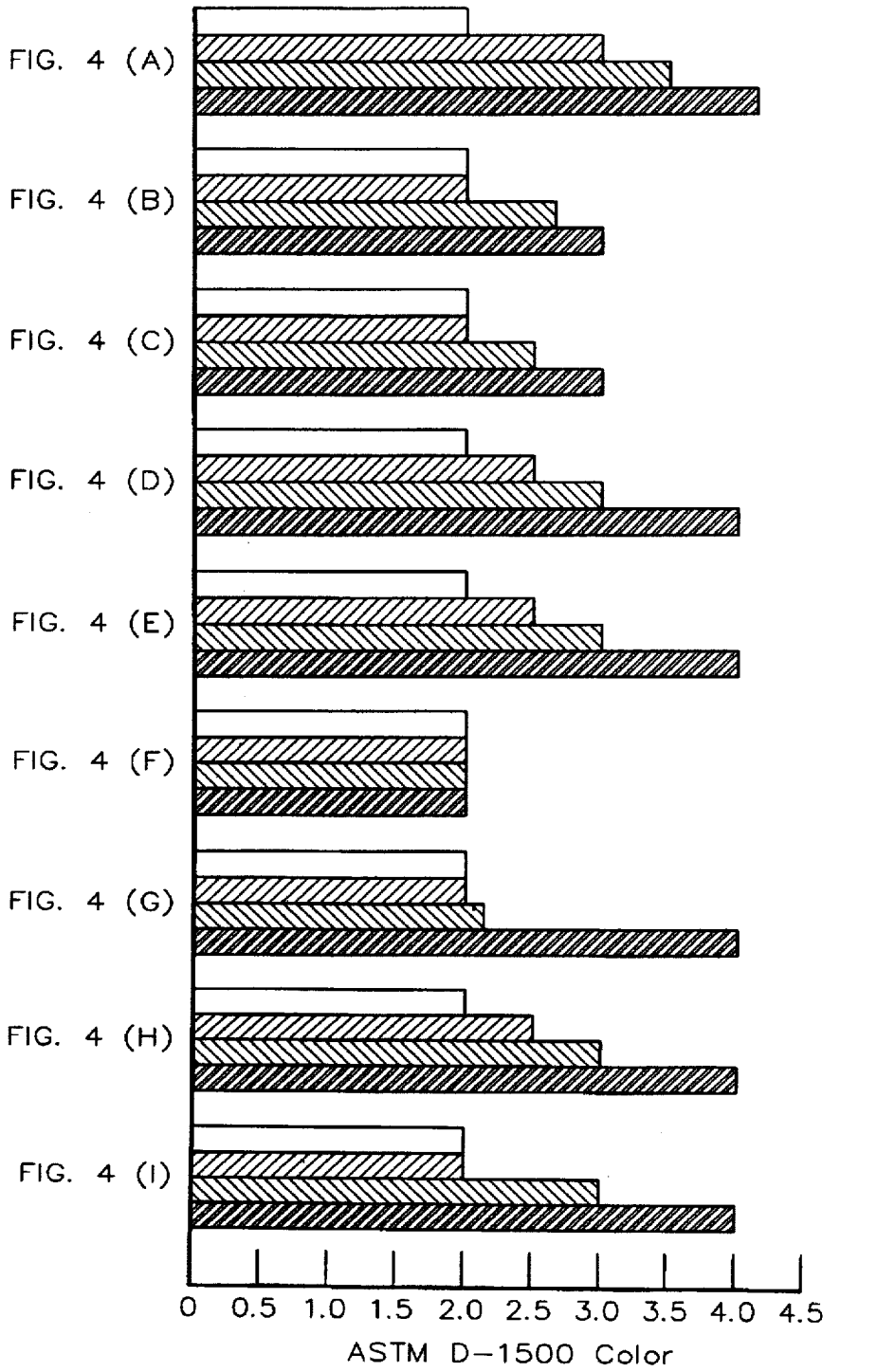
*FIG. 4*
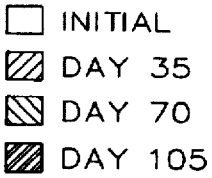

STABILIZATION OF HYDROCARBONS BY THE ADDITION OF HYDRAZINE

This application is a division of application Ser. No. 08/261,595, filed on Jun. 17, 1994, now U.S. Pat. No. 5,470,457.

BACKGROUND OF THE INVENTION

This invention relates to inhibiting distillate fuel oil fouling, which is manifested by color degradation, particulate formation and gum generation in distillate fuel oils.

During hydrocarbon processing, transportation and storage, the hydrocarbons deteriorate, particularly when subjected to elevated temperatures. The deterioration usually results in the formation of sediment, sludge, or gum and can manifest itself visibly by color deterioration. Color deterioration may prevent the sale of fuel oil. Sediment, sludge, or gum formation may cause clogging of equipment or fouling of engines and processing equipment, such as, for example, heat exchangers, compressors, furnaces, reactors and distillation equipment. The fouling is caused by the gradual accumulation of high molecular weight polymeric material on the inside surfaces of the equipment. As fouling continues, the efficiency of the operation associated with hydrocarbon processing equipment, such as heat exchangers, compressors, furnaces, reactors and distillation equipment, decreases. The hydrocarbons which may result in significant fouling include the straight run distillates (kerosene, diesel, jet), naphthas, catalytic cracker feedstocks (gas oils), light and heavy cycle oils, coker naphthas, residual fuel oils, petrochemical plant feedstocks, and hydrotreated products of the above.

It has been found that in some types of color degradation, particulate formation and gum generation can be traced to the presence of heteroaromatic compounds in the hydrocarbons. It is believed that these compounds react and/or oxidize to cause degradation of the hydrocarbons. Therefore, it is desirable to develop methods for preventing the reactions and/or oxidation of these compounds and thus the degradation of the hydrocarbons.

SUMMARY OF THE INVENTION

It is an object of the present invention to provide a hydrocarbon composition, containing at least one heteroaromatic, which exhibits increased color stability.

The above object is realized in a composition comprising at least one hydrocarbon fluid, at least one heteroaromatic and at least one hydrazine additive which is selected from the group consisting of the hydrazine family.

According to yet another aspect of the invention there is provided a composition comprising at least one hydrocarbon fluid, at least one heteroaromatic, at least one hydrazine additive selected from the group consisting of the hydrazine family and at least one antioxidant additive.

BRIEF DESCRIPTION OF THE DRAWINGS

FIG. 1 is a bar graph illustrating the color development of several hydrocarbon fluid compositions aged at 110° F. (about 43° C.) over a period of 90 days. The hydrocarbon fluid compositions include a light cycle oil with hydrazine added, light cycle oil with antioxidant additives added and light cycle oil with both an antioxidant additives added and hydrazine added.

FIG. 2 is a bar graph illustrating the effect on the color development of a hydrocarbon fluid composition aged at room temperature when hydrazine is added.

FIG. 3 is a bar graph illustrating the effects on the color development of a hydrocarbon fluid composition aged at 110° F. (about 43° C.) when hydrazine is added.

FIG. 4 is a bar graph illustrating the effect on the color development of a hydrocarbon fluid composition aged at room temperature when hydrazine or hydrazine hydrate is added.

DESCRIPTION OF THE PREFERRED EMBODIMENTS

Figure 5:
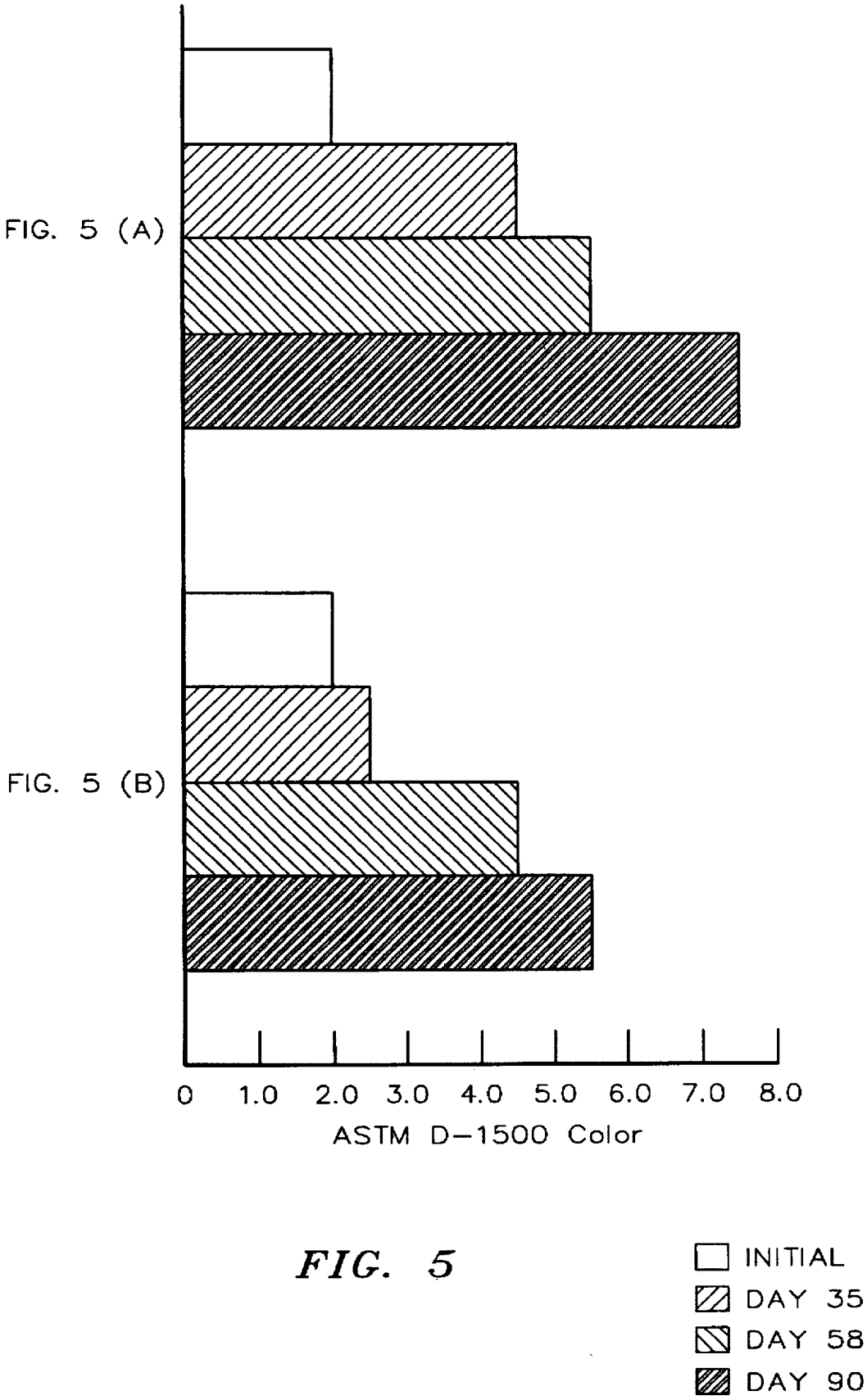
FIG. 5 is a bar graph illustrating the effect on the color development of a hydrocarbon fluid composition aged at 110° F. (about 43° C.) when hydrazine hydrate is added.

The present invention pertains to the use of members of the hydrazine family as an additive in a fluid comprising hydrocarbons and heteroaromatics in order to inhibit the formation of colored materials and/or gummy deposits.

According to the invention, at least one hydrazine additive which is a member of the hydrazine family is blended with a fluid comprising at least one hydrocarbon and at least one heteroaromatic in order to inhibit the formation of colored materials and/or gummy deposits. Preferably, such hydrazine additives are blended with the fuel prior to the degradation of fuel. In another embodiment an antioxidant additive and at least one hydrazine additive which is a member of the group consisting of the hydrazine family is blended with the hydrocarbon fluid.

Any suitable hydrocarbon fluid which also contains a small amount of heteroaromatics, generally about 20 ppm (parts by weight of nitrogen contained in the heteroaromatic per million parts by weight of hydrocarbon fluid) to about 1500 ppm, preferably about 500–1200 ppm heteroaromatic, more preferably about 600 ppm heteroaromatic, can be used as the hydrocarbon fluid to be color stabilized in the current invention. Particularly suited fluids (if they contain heteroaromatic impurities) are normally liquid (i.e., liquid at about 20° C. at 1 atm.) hydrocarbon-containing mixtures, preferably those having a boiling range of about 200° F. to about 800° F. (about 93° C. to about 426° C.) more preferably about 350° F. to about 650° F. (about 177° C. to about 343° C.), at atmospheric pressure. Non-limiting examples of such hydrocarbon-containing liquids are heavy naphtha, kerosene, light gas oils, light cycle oils (produced during catalytic cracking of petroleum or shale oil), and the like. Many of these hydrocarbon-containing feeds are used as feedstocks for making gasoline, diesel fuels, jet engine fuels, heating oils, lubricating oils, and the like.

Heteroaromatic, as used herein, refers to those compounds with the formula:

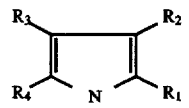

where $R_1$, $R_2$, $R_3$ and $R_4$ are hydrogen or alkyl, aryl, or alkaryl groups and include aryl compounds where the ring structure is completed through another portion of the molecule, that is, any two $R_i$ may together form part of the aryl ring. Generally, the heteroaromatics will have alkyl, aryl and alkaryl groups with 1 to 50 carbon atoms and more typically 1–20 carbon atoms. Examples are indole, 2-methylindole, 3-methylindole, 2,3-dimethylindole, 2,5-dimethylindole, 1,2-dimethylindole and similarly substituted carbazole.

Two common heteroaromatics are indole:

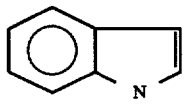

and carbazole:

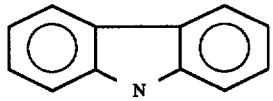

The hydrazine additive of this invention is a member of the hydrazine family, consisting of hydrazine, a substituted hydrazine, or the corresponding hydrazine hydrate. For reasons of economy and particular suitability, unsubstituted hydrazine ($N_2H_4$) is preferred; but hydrazines substituted (either symmetrically or unsymmetrically) with from one to three hydrocarbon or substituted hydrocarbon radicals are also suitable. The ten "hydrocarbon radical" as used herein includes aliphatic, cycloaliphatic and aromatic (including aliphatic- and cycloaliphatic-substituted aromatic and aromatic-substituted aliphatic and cycloaliphatic) radicals. It also includes cyclic radicals wherein the ring is completed through another portion of the molecule; that is, any two indicated substituents may together form a cycloalkyl radicals.

The following are illustrative of hydrocarbon radicals within the scope of this invention. Where a named radicals has several isomeric forms (e.g., butyl), all such forms are included.

| | |
|---|---|
| Methyl | Benzyl |
| Ethyl | Cyclohexyl |
| Propyl | Cyclopentyl |
| Butyl | Methylcylopentyl |
| Hexyl | Cyclopentadienyl |
| Octyl | Vinylphenyl |
| Decyl | Isopropenylphenyl |
| Vinyl | Cinnamyl |
| Allyl | Naphthyl |
| Ethynyl | |
| Propargyl | |
| Phenyl | |
| Tolyl | |
| $-C_6H_3(C_3H_3)_3$ | |
| $-C_6H_4(CH_2)_{11}CH_3$ | |

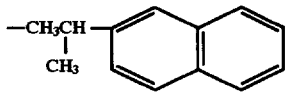

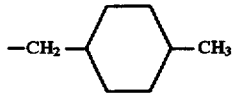

Many obvious variations of these radicals will be apparent to those skilled in the art and are included within the scope of the invention.

The term "hydrocarbon radical" includes substituted hydrocarbon radicals. By "substituted" is meant radicals containing substituents which do not alter significantly the character of reactivity of the radicals. Examples are:

Halide (fluoride, chloride, bromide, iodide)
Hydroxy
Ether (especially lower alkoxy)
Keto
Aldehydo
Ester (especially lower carbalkoxy)
Aminoacyl(amide)
Nitro
Cyano
Thioether
Sulfoxy
Sulfone In general, no more than about three such substituent groups will be present for each 10 carbon atoms in the radicals.

Preferably, the hydrocarbon or substituted hydrocarbon radicals in the compounds of this invention are free from ethylenic and acetylenic unsaturation and have no more than about 30 carbon atoms, desirably no more than about 12 carbon atoms. A particular preference is expressed for lower hydrocarbon radicals, the word "lower" denoting radicals containing up to seven carbon atoms. Still more preferably, they are lower alkyl or aryl radicals, most often alkyl.

Examples of substituted hydrazines useful as the hydrazine additive are hydrazine, methylhydrazine, N,N-dimethylhydrazine, N,N'-dimethylhydrazine, N,N,N'-phenylhydrazine, N-phenyl-N'-ethylhydrazine, N-phenyl-N,N'-diethylhydrazine; N-(p-Tolyl)-N'-(n-butyl)-hydrazine, N-(p-nitrophenyl)-N-methylhydrazine, N,N'-di(p-chlorophenyl)hydrazine and N-phenyl-N'-cyclohexylhydrazine.

While not wishing to be bound by theory, it is believed that the hydrazine additive acts as an oxygen scavenger. Thus, it reacts with the oxygen present in the hydrocarbon fluid and effectively scavenges oxygen from the fluid to prevent other oxygen reactions which might cause the formation of colored materials and/or gummy deposits. Accordingly, the hydrazine additive should be present in amounts up to the amount of the precursors to color formation. Generally, from about 30 ppm to 2000 ppm, hydrazine should be used. Preferably, from about 100 ppm to about 1000 ppm, hydrazine should be used, and most preferably, from 300 ppm to 700 ppm. The amounts listed refer to the parts by weight of active hydrazine per million parts by weight of hydrocarbon fluid. If the hydrated form of a hydrazine is used, the amounts must be adjusted to account for the water contained in the hydrazine hydrate.

Antioxidant additives as used herein refers to organic compounds which can be added to the hydrocarbon fluid to interrupt the initiation or propagation steps of a reaction or series of reactions which results in oxidation and the formation of colored materials and/or gummy deposits. Thus, the antioxidant additives do not react with oxygen present within the hydrocarbon fluid, but, rather, deter or slow down the reactions of other compounds present in the fuel with oxygen. Examples of antioxidants are: poly[[6-[(1,1,3,3-tetramethylbutyl)amino]-S-triazine-2,4-diyl][(2,2,6,6-tetramethyl-4-piperidyl)imino]hexa-methylene[(2,2,6,6-tetra-methyl-4-piperidyl)imino]] available under the tradename Chimassorb® 944 available from Ciba-Geigy Corp., Hawthorne, N.Y.; and dodecyl-N-(1,2,2,6,6-pentamethyl-4-piperidinyl)-succinimide available under the tradename Cyasorb® 3604 available from Ciba-Geigy Corp., Hawthorne, N.Y.

The antioxidant additives should be added to the hydrocarbon-containing fluid in an effective inhibiting amount to either eliminate or effectively reduce the formation of colored materials and/or gummy deposits. Generally, the amount will be in the range of from about 0.1 ppm (parts by weight of antioxidant additive per million parts by weight of hydrocarbon fluid) to about 500 ppm, preferably from about 0.2 ppm to about 300 ppm, and most preferably from 0.5 ppm to 100 ppm.

The hydrazine additives and the antioxidant additives can be blended with the hydrocarbon-containing fluid by any conventional method. The additives can be added either as a concentrate or as a solution using a suitable carrier solvent which is compatible with the additive and the hydrocarbon-containing fluid. The additives can also be added at ambient temperature and pressure to stabilize the hydrocarbon-containing fluid during storage and prior to processing. The additives can be introduced into the equipment to be protected from fouling just upstream of the point of fouling. The additives are preferably added to the hydrocarbon-containing fluid prior to any appreciable degradation of the fuel oil, i.e. prior to the formation of any colored materials and/or gummy deposits, as this will either eliminate degradation or effectively reduce the formation of particle matter and/or color degradation and eliminate or reduce subsequent fouling during processing. However, the mixture is also effective even after some degradation has occurred.

In order to more clearly illustrate this invention the data set forth below was developed. The following examples are included as being illustrations of the invention and should not be construed as limiting the scope thereof.

EXAMPLES

Light cycle oil (LCO) samples containing a small amount of heteroaromatics were used in each control and in each trial example. The color of each sample was measured according to ASTM D-1500-91.

Control I

A sample of a LCO was aged at 110° F. (about 43° C.) for 90 days. The initial color was 2.0. After 90 days the color was 6.5. These color values, along with the 35-day color and the 58-day color value, are shown in FIG. 1(A).

Example I

Three samples of the same LCO as used in Control I were treated with 20 ppm light stabilizers Cyasorb® 3604 (a hindered mine), Chimassorb® 944, and FOA #6, respectively. FOA #6 is an organic aliphatic amine additive produced by E. I. Du Pont De Nemours and Company, Incorporated. The initial color of each treated sample was 2.0. Each sample was aged at 110° F. for 90 days. The color values after 90 days were measured: for the Cyasorb® 3604 sample FIG. 1(B), the color was 6.0; for the Chimassorb® 944 sample FIG. 1(C), the color was 6.0; and for the FOA #6 sample FIG. 1(D), the color was 6.0. These colors along with the initial and intermediate (35-day and 58-day) color values are shown in the Figures.

Example II

Two samples of the same LCO as used in Control I were treated with 1000 ppm hydrazine and 300 ppm hydrazine, respectively and the results are shown in FIGS. 1(E) and 1(F), respectively. They were checked for color and aged using the same procedure as Control I. The initial color of each sample was 2.0. The final color of each sample was 5.0. The initial, intermediate and final color values are shown in FIGS. 1(E) and 1(F).

Example III

Three samples of the same LCO as used in Control I were each treated with 500 ppm hydrazine. The samples were also treated with 20 ppm Chimassorb® 944, Cyasorb® 3604, and FOA #6, and the results are illustrated in FIGS. 1(G), 1(H) and 1(J), respectively. The samples were checked for color and aged using the same procedure as Control I. The initial color of each sample was 2.0. The final colors were: 2.0 for the Chimassorb® 944 sample; 2.0 for the Cyasorb® 3604; and 2.5 for the FOA #6 sample. The initial, intermediate and final color values are shown in the Figures.

The samples of LCO containing a hydrazine additive showed some improvement in reduction of color development over the control. Similarly, the samples containing an antioxidant additive showed some improvement. However, the samples containing both an antioxidant additive and a hydrazine additive showed a great improvement in reduction of color development with little or no change in color over the 90 days.

Control II

A 220 gm sample of LCO was aged at room temperature for 105 days. The color value of the sample was determined initially and after 35, 70 and 105 days. The results are shown in FIG. 2(A).

Example IV

Three samples of 220 gm of the same LCO as was used in Control II were treated with 300 mg, 100 mg and 30 mg of hydrazine, respectively. The samples were aged and checked for color as in Control II. The results are shown in FIGS. 2(B), 2(C) and 2(D), respectively.

Samples of a LCO containing 300 and 100 mg hydrazine per 220 grams of LCO remained unchanged in color for 105 days at room temperature. Over this same time period, the ASTM-D-1500 color of the control had increased from 2.0 to 3.5.

Control III

A 220 gm sample of LCO was aged at 110° F. (about 43° C.) for 96 days. The color value of the sample was determined initially and after 35, 60 and 96 days of aging. The results are shown in FIG. 3(A).

Example V

Three samples of 220 gm of the same LCO as was used in Control III were treated with 300 mg, 100 mg and 30 mg of hyrazine, respectively. The samples were aged and checked for color as in Control III. The results are shown in FIGS. 3(B), 3(C) and 3(D), respectively.

The accelerated aging test at 110° F. of LCO samples (depicted in FIG. 3), shows a 2 unit reduction in color for a 220 g LCO sample containing 300 mg hydrazine. Lesser amounts of hydrazine reduce the degree of color stabilization.

Control IV

A sample of LCO was aged at room temperature for 105 days. The color value of the sample was determined initially and after 35, 70 and 105 days. The results are illustrated in FIG. 4(A).

Example VI

Four samples of the same LCO as was used in Control IV were treated with 30 ppm, 100 ppm, 300 ppm and 1000 ppm of hydrazine, respectively. Four additional samples were treated with 60 ppm, 200 ppm, 600 ppm and 2000 ppm hydrazine hydrate (64% hydrazine). The samples were aged and checked for color as in Control IV.

The samples of LCO containing 1000, 300, 100 and 30 ppm of hydrazine and 2000, 600, 200 and 60 ppm hydrazine hydrate showed reductions in color development as detailed in FIGS. 4(B), 4(C), 4(D), 4(E), 4(F), 4(G), 4(H) and 4(I), respectively.

Control V

A sample of LCO was aged in a convection oven at 110° F. (about 43° C.) for 90 days. The color of the sample was determined initially and after 35, 58 and 90 days of aging. The results are shown in FIG. 5(A).

Example VII

A sample of the same LCO as was used in Control V containing 600 ppm of hydrazine hydrate was aged in a convection oven at 110° F. (about 43° C.) for 90 days. The color of the sample was determined initially and after 35, 58 and 90 days of aging. The results are shown in FIG. 5(B).

The sample of LCO containing 600 ppm of hydrazine hydrate increased in color from 2.0 to 5.5 (FIG. 5(B)) when aged for 90 days at 110° F. (about 43° C.), while the color of the sample of Control V increased from 2.0 to 7.5 (FIG. 5(A)).

Control VI

A sample of LCO was aged at room temperature for 105 days. The color of the sample was determined initially and after 35, 70 and 105 days of aging. The results are shown in FIG. 6(A).

Example VIII

A sample of the same LCO as used in Control VI containing 1480 ppm of hydrazine was aged at room temperature for 105 days. The color of the sample was determined initially and after 35, 70 and 105 days of aging. The results are shown in FIG. 6(B).

Figure 6:
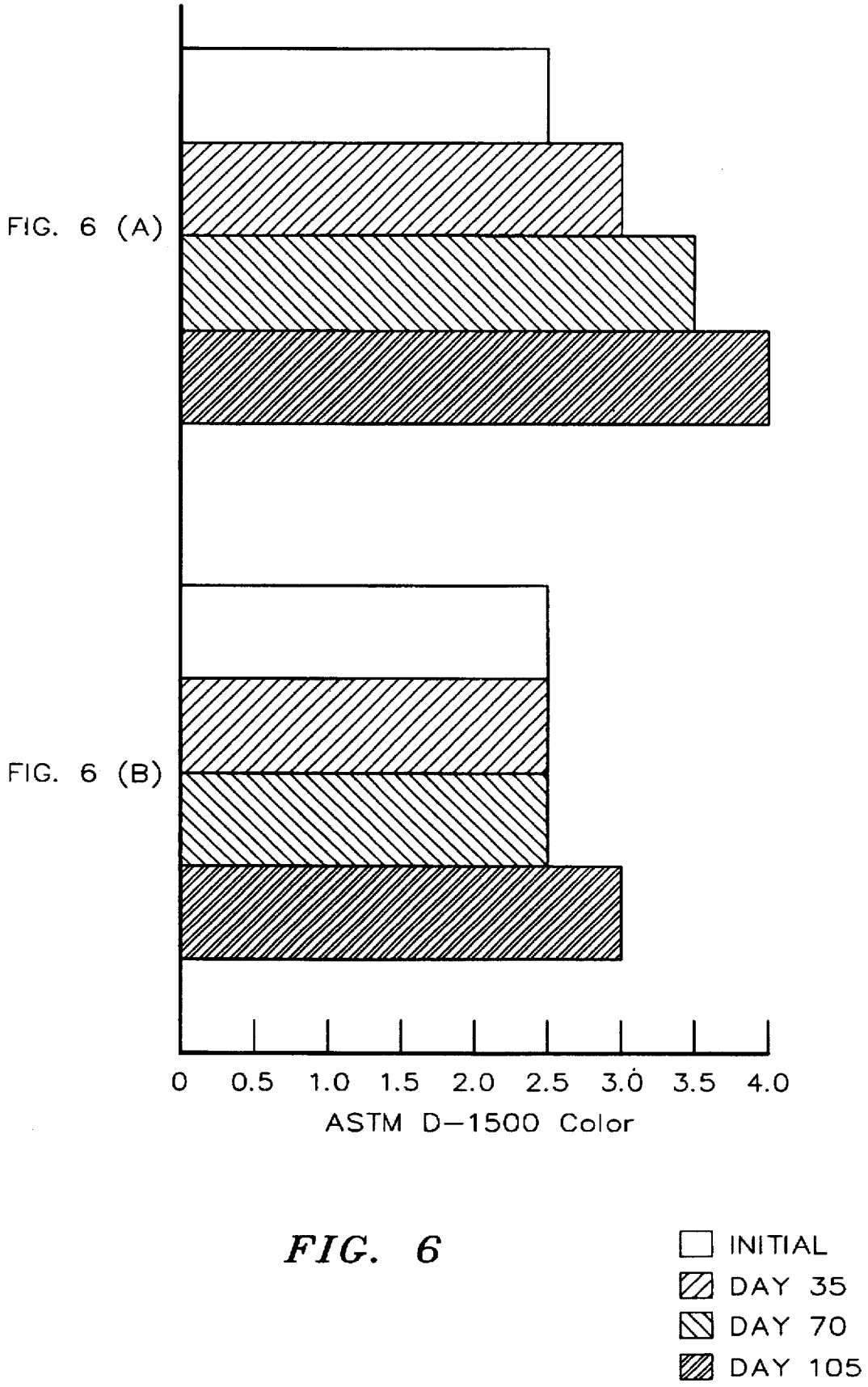
FIG. 6 is a bar graph illustrating the effect on the color development of a hydrocarbon fluid composition aged at room temperature when hydrazine is added.

The LCO sample containing 1480 ppm of hydrazine remained unchanged in color for 70 days at room temperature FIG. 6(B), while the sample of Control VI had increased in color from 2.5 to 3.5 (FIG. 6(A)).

Control VII

A sample of LCO was aged for 90 days at 110° F. (about 43° C.). The color of the sample was determined initially and after 35, 59 and 90 days. The results are shown in FIG. 7(A).

Example IX

A sample of the same LCO as was used in Control VII containing 1480 ppm of hydrazine and a sample of LCO as used in Control VII containing 350 ppm of hydrazine were aged for 90 days at 110° F. (about 43° C.). The color of each sample was determined initially and after 35, 59 and 90 days. The results are shown in FIG. 7(B) and 7(C), respectively.

Figure 7:
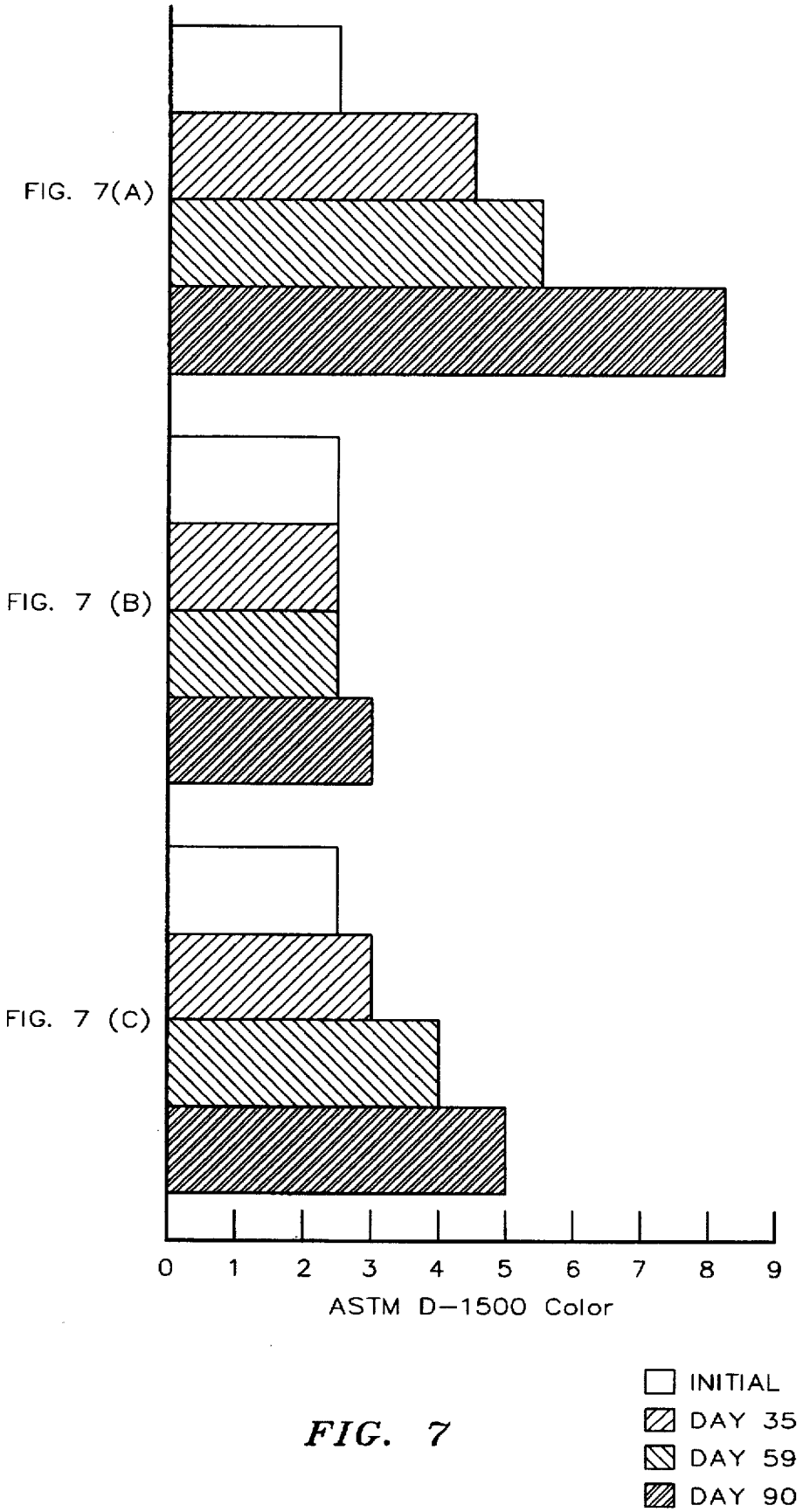
FIG. 7 is a bar graph illustrating the effects on the color development of a hydrocarbon fluid composition aged at 110° F. (about 43° C.) when hydrazine is added.

In the accelerated test at 110° F. the LCO samples containing 1480 ppm and 350 ppm of hydrazine had greatly improved color stability, as depicted in FIGS. 7(B) and 7(C), respectively. After aging for 90 days at 110° F. the ASTM D-1500 color value of the sample with 1480 ppm hydrazine, the sample with 350 ppm hydrazine, and the sample of Control VII were 3.0, 5.0 and 8.0, respectively. The starting color of the LCO samples was 2.6.

An examination of the above examples and associated figures discloses that when hydrazine is added to light cycle oil without additional additives, it acts to retard the formation of colored materials and, hence, gummy deposits. Additionally, the examination shows that when both hydrazine and an antioxidant additive are added to the light cycle oil, there is a dramatic drop in colored material formation over no additives, or either a hydrazine additive or an antioxidant additive alone. The resulting retardation in colored material formation surpasses what would be expected from the examination of the effects of either the hydrazine additive or antioxidant additives alone.

Reasonable variations and modifications which will be apparent to those skilled in the art can be made within the Scope of the disclosure and appended claims without departing from the scope of this invention.

That which is claimed is:

1. A composition comprising at least one hydrocarbon fluid, at least one nitrogen containing heteroaromatic, at least one hydrazine additive selected from the group consisting of hydrazine and substituted hydrazines, and at least one antioxidant additive.

2. A composition according to claim 1 wherein said antioxidant additive is present in an amount from about 0.1 ppm to about 500 ppm.

3. A composition comprising at least one hydrocarbon fluid, indole, from 300 ppm to 700 ppm hydrazine and from 0.5 ppm to 100 ppm of an antioxidant additive.

4. A composition according to claim 1 wherein said heteroaromatic is indole.

5. A composition according to claim 1 wherein said hydrazine additive is present in an amount effective for inhibiting the oxidation of said heteroaromatic.

6. A composition according to claim 1 wherein said hydrazine additive is present in an amount from about 30 ppm to about 2000 ppm.

7. A composition according to claim 1 wherein said hydrazine additive is present in an amount from 100 ppm to 1000 ppm.

8. A composition according to claim 1 wherein said hydrazine additive is hydrazine.

* * * * *